US012650271B2

(12) United States Patent
Matsuda et al.

(10) Patent No.: US 12,650,271 B2
(45) Date of Patent: Jun. 9, 2026

(54) COLD PLATE

(71) Applicant: Fujikura Ltd., Tokyo (JP)

(72) Inventors: Masahiro Matsuda, Tokyo (JP); Yoji Kawahara, Tokyo (JP)

(73) Assignee: Fujikura Ltd., Tokyo (JP)

( * ) Notice: Subject to any disclaimer, the term of this patent is extended or adjusted under 35 U.S.C. 154(b) by 84 days.

(21) Appl. No.: 18/538,246

(22) Filed: Dec. 13, 2023

(65) Prior Publication Data

US 2024/0200888 A1 Jun. 20, 2024

(30) Foreign Application Priority Data

Dec. 19, 2022 (JP) ..... 2022-201933

(51) Int. Cl.
*H01L 23/46* (2006.01)
*F28F 3/12* (2006.01)
*H01L 23/473* (2006.01)

(52) U.S. Cl.
CPC ..... *F28F 3/12* (2013.01)

(58) Field of Classification Search
CPC .... H01L 23/4735; H01L 23/473; H01L 23/46
See application file for complete search history.

(56) References Cited

U.S. PATENT DOCUMENTS

2006/0002087 A1* 1/2006 Bezama ..... H01L 23/473 257/E23.098
2006/0096738 A1 5/2006 Kang et al.
2006/0108098 A1* 5/2006 Stevanovic ..... H01L 23/473 257/E23.098
2007/0050980 A1 3/2007 Vetter
2008/0210405 A1* 9/2008 Datta ..... F28D 15/0266 257/E23.098
2008/0301941 A1* 12/2008 Anderson, Jr. ..... B23K 26/32 29/890.03
2009/0071625 A1* 3/2009 Lyon ..... F28D 15/00 165/104.19
2015/0034280 A1* 2/2015 Himmelmann ..... H01L 23/473 165/104.33
2018/0213677 A1* 7/2018 Wu ..... H01L 23/473
2019/0271513 A1 9/2019 Chainer et al.
(Continued)

FOREIGN PATENT DOCUMENTS

EP 3913465 A1 11/2021
JP 2010109079 A 5/2010
JP 2014079975 A 5/2014
(Continued)

*Primary Examiner* — Frantz F Jules
*Assistant Examiner* — Jason N Thompson
(74) *Attorney, Agent, or Firm* — Osha Bergman Watanabe & Burton LLP

(57) ABSTRACT

A cold plate includes a housing, which in turn includes a metal base plate and a resin cover. The metal base plate includes: a base part; and a heat exchange part that transfers heat absorbed from a heating element to a refrigerant. The resin cover includes an outer wall part joined to the base part. The housing has: an internal space, surrounded by the base part and the outer wall part, in which the heat exchange part is disposed; an inflow hole that communicates with the internal space and into which the refrigerant flows; and an outflow hole that communicates with the internal space and through which the refrigerant flows out.

9 Claims, 11 Drawing Sheets

(56) References Cited

U.S. PATENT DOCUMENTS

| | | | | |
|---|---|---|---|---|
| 2020/0003497 | A1* | 1/2020 | Aston | B22F 12/38 |
| 2020/0227341 | A1* | 7/2020 | Neal | F28F 3/12 |

FOREIGN PATENT DOCUMENTS

| | | | |
|---|---|---|---|
| JP | 2014183260 | A | 9/2014 |
| JP | 2017005181 | A | 1/2017 |
| JP | 2021163815 | A | 10/2021 |
| JP | 2022069115 | A | 5/2022 |
| WO | 2017090106 | A1 | 6/2017 |
| WO | 2020174593 | A1 | 9/2020 |

* cited by examiner

COLD PLATE

Priority is claimed on Japanese Patent Application No. 2022-201933 filed on Dec. 19, 2022, the content of which is incorporated herein by reference.

TECHNICAL FIELD

The present invention relates to a cold plate.

BACKGROUND

Conventionally, a metal cold plate that cools a heating element by using a refrigerant flowing through an internal space of a housing is known (for example, see Patent Document 1).

PATENT LITERATURE

[Patent Document 1] PCT International Publication No. WO 2020/174593

Due to an increase in heat generation density according to high integration of electronic components in recent years, higher cooling performance in cold plates is required. In regard to this problem, a cold plate in which a so-called jet cooling method or two-phase flow cooling method is employed to improve a cooling performance has been proposed. For example, Patent Document 1 discloses a two-phase flow cooling type cold plate. A jet cooling type or a two-phase flow cooling type cold plate generally has a low-temperature flow path through which a refrigerant before receiving heat from a heating element flows, and a high-temperature flow path through which the refrigerant after receiving heat from the heating element flows.

However, when the cold plate is made of a metal (for example, Patent Document 1), there have been cases in which it is not easy to form a complicated refrigerant flow path including the high-temperature flow path and the low-temperature flow path.

SUMMARY

One or more embodiments of the present invention provide a cold plate in which it is possible to easily form a refrigerant flow path including both a high-temperature flow path and a low-temperature flow path.

A cold plate according to one or more embodiments of the present invention includes a housing including a metal base plate and a resin cover, in which the base plate has a base part, the resin cover has an outer wall part joined to the base part, the housing has: an internal space surrounded by the base part and the outer wall part; an inflow hole communicating with the internal space, into which a refrigerant flows; and an outflow hole communicating with the internal space, through which the refrigerant flows out, the base plate includes a heat exchange part, the heat exchange part is positioned in the internal space, the heat exchange part transmits (i.e., transfers) heat received (i.e., absorbed) from a heating element to the refrigerant, the resin cover includes a low-temperature flow path and a high-temperature flow path, the low-temperature flow path is positioned in the internal space, the refrigerant before receiving heat from the heat exchange part flows through the low-temperature flow path, the high-temperature flow path is positioned in the internal space, the refrigerant after receiving heat from the heat exchange part flows through the high-temperature flow path, and the high-temperature flow path does not open to (i.e., is separated from) the low-temperature flow path.

According to the above described embodiments of the present invention, since the low-temperature flow path and the high-temperature flow path are provided in the resin cover, it is possible to form the flow paths more easily than, for example, when the flow paths are formed of a metal.

According to one or more embodiments of the present invention, in the cold plate of the above described embodiments, the resin cover may include a partition wall portion, the partition wall portion may separate the low-temperature flow path and the high-temperature flow path, and the partition wall portion may be joined to the base plate.

According to one or more embodiments of the present invention, in the cold plate of the above described embodiments, the partition wall portion may be joined to the heat exchange part.

According to one or more embodiments of the present invention, in the cold plate of any one of the above described embodiments, the low-temperature flow path may open to the heat exchange part at a first portion, the high-temperature flow path may open to the heat exchange part at a second portion, the first portion may be different from the second portion in position in a second direction intersecting a first direction, the high-temperature flow path may extends in the first direction, and the heat exchange part may include a plurality of fins extending in the second direction.

According to one or more embodiments of the present invention, in the cold plate of any one of the above described embodiments, the outer wall part, the low-temperature flow path, and the high-temperature flow path may be integrally formed.

According to one or more embodiments of the present invention, in the cold plate of any one of the above described embodiments, the high-temperature flow path may have a shape gradually broadening toward the outflow hole.

According to the above described embodiments of the present invention, it is possible to provide a cold plate in which it is possible to easily form the refrigerant flow path including both the high-temperature flow path and the low-temperature flow path.

DETAILED DESCRIPTION

First Embodiment

Hereinafter, a cold plate according to a first embodiment of the present invention will be described on the basis of the drawings.

Figure 1:
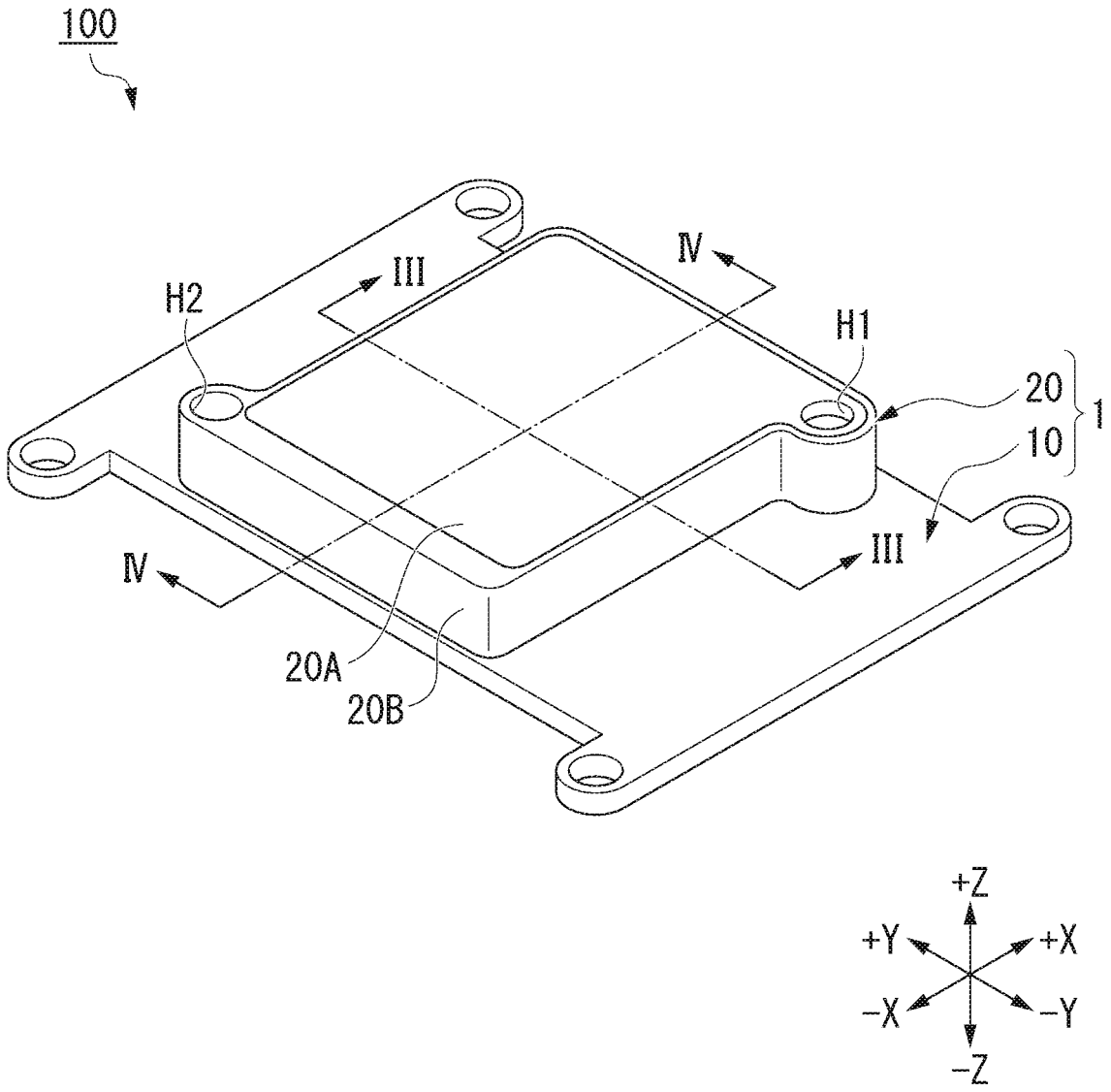
FIG. 1 is a perspective view illustrating a cold plate according to a first embodiment of the present invention.
Figure 2:
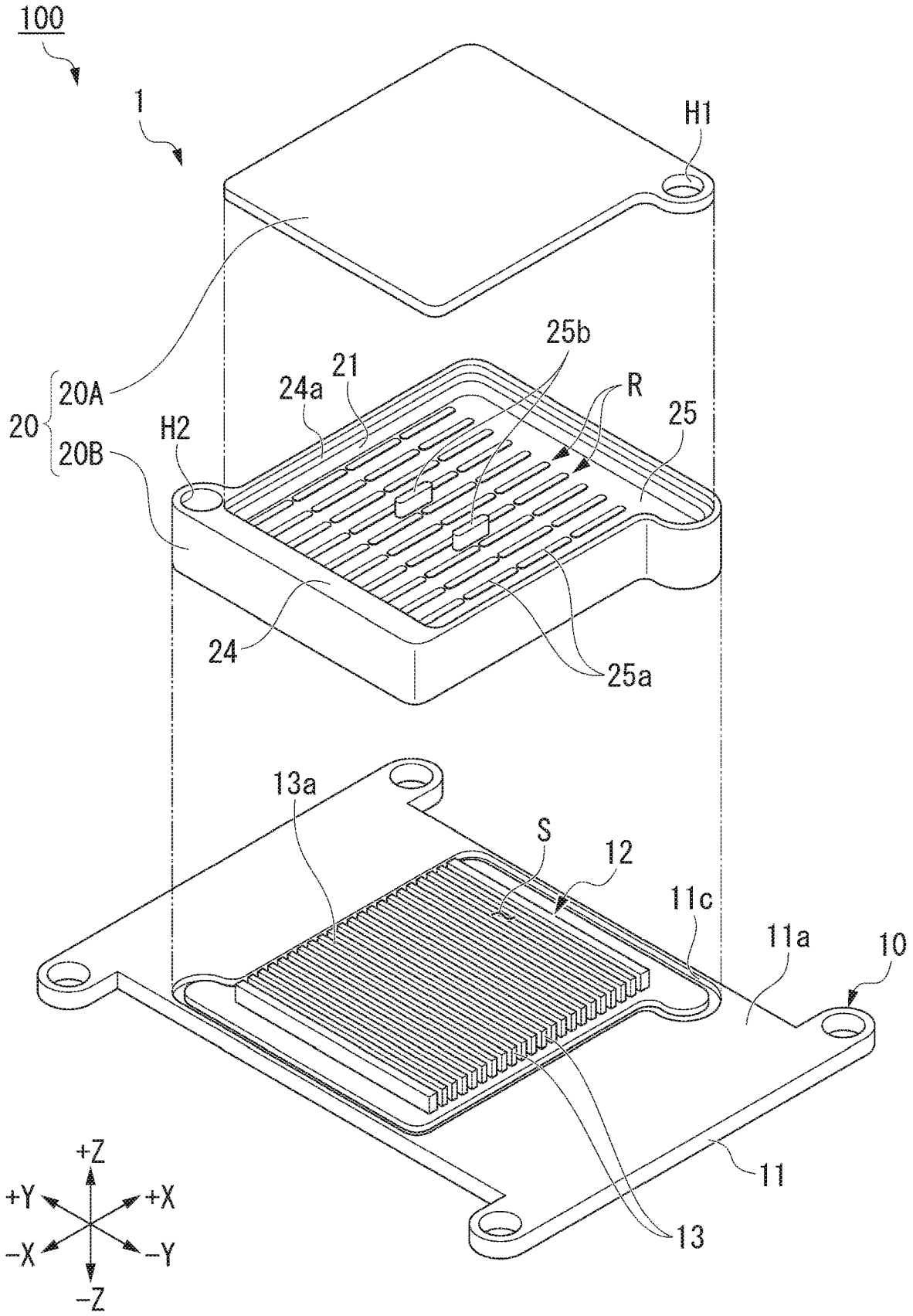
FIG. 2 is an exploded view illustrating the cold plate according to the first embodiment of the present invention.
Figure 3:
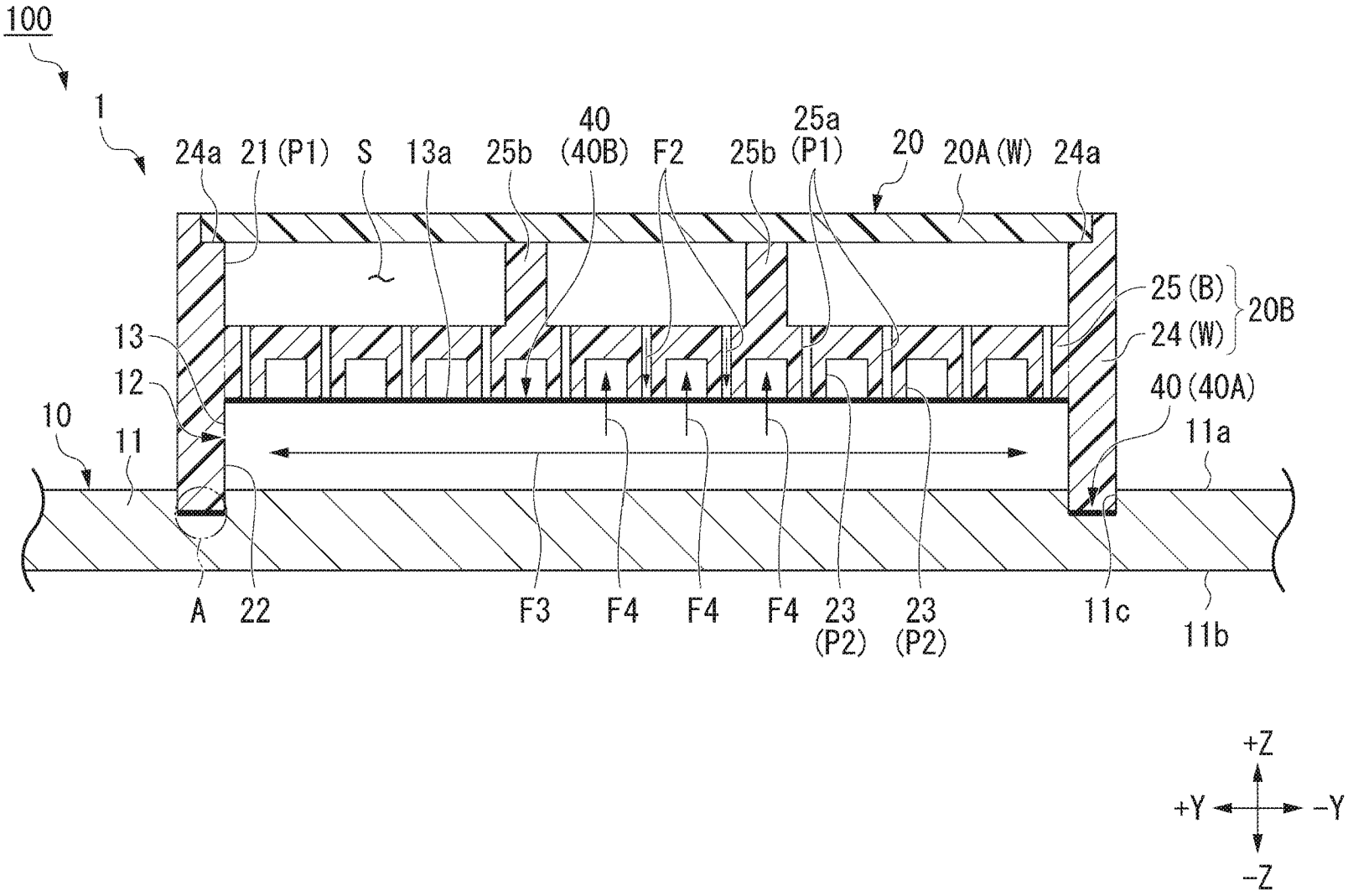
FIG. 3 is a cross-sectional view taken along line III-III illustrated in FIG. 1.
Figure 4:
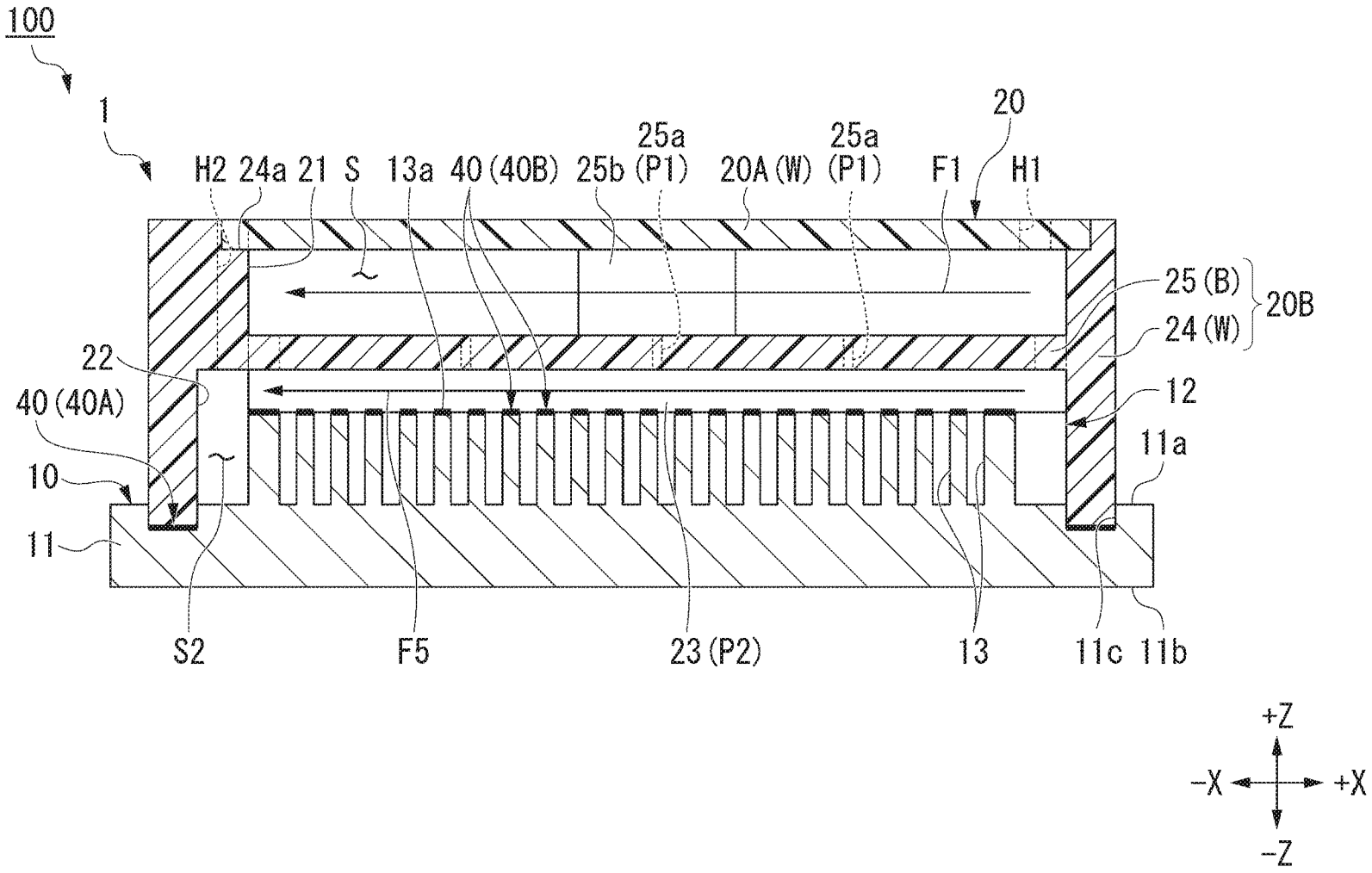
FIG. 4 is a cross-sectional view taken along line IV-IV illustrated in FIG. 1.

As illustrated in FIGS. 1 and 2, a cold plate 100 according to the present embodiment may include a flat housing 1 having a metal base plate 10 and a resin cover 20. Also, as illustrated in FIGS. 2 to 4, an internal space S, an inflow hole H1 communicating with the internal space S and into which a refrigerant flows, and an outflow hole H2 communicating with the internal space S and through which the refrigerant flows out are formed in the housing 1.

Definition of Directions

Here, in the present embodiment, a thickness direction of the cold plate 100 may be simply referred to as a thickness direction Z. The thickness direction Z is also a direction in which the base plate 10 and the resin cover 20 face each other. A view from the thickness direction Z is referred to as a plan view. Also, one direction intersecting (for example, orthogonal to) the thickness direction Z is referred to as a first direction X. Also, a direction intersecting (for example, orthogonal to) both the thickness direction Z and the first direction X is referred to as a second direction Y. Also, a direction directed to the resin cover 20 from the base plate 10 in the thickness direction Z is referred to as a +Z direction or an upward direction. A direction opposite to the +Z direction is referred to as a −Z direction or a downward direction. One direction in the first direction X is referred to as a +X direction. A direction opposite to the +X direction is referred to as a −X direction. One direction in the second direction Y is referred to as a +Y direction. A direction opposite to the +Y direction is referred to as a −Y direction.

As a material of the base plate 10, a metal such as copper, a copper alloy, aluminum, or an aluminum alloy may be used. As illustrated in FIGS. 2 to 4, the base plate 10 according to the present embodiment may include a plate-shaped base part 11 and a heat exchange part 12.

As illustrated in FIGS. 3 and 4, the base part 11 has a first surface 11*a* facing upward, and a second surface 11*b* positioned on a side opposite to the first surface 11*a* and facing downward. The heat exchange part 12 is formed on the first surface 11*a*. The base part 11 and the heat exchange part 12 may be formed integrally or may be formed separately. A heating element, a heat transfer member, or the like (not illustrated) is in contact with the second surface 11*b*.

As illustrated in FIGS. 2 to 4, the heat exchange part 12 according to the present embodiment may include a plurality of fins 13 extending in the second direction Y. The fins 13 each have a plate shape extending in the second direction Y and the thickness direction Z. Each fin 13 has an upper end surface 13*a* facing upward. The heat exchange part 12 has a role of transmitting heat received from a heating element (not illustrated) to a refrigerant. Since the heat exchange part 12 has the plurality of fins 13, a contact area between the heat exchange part 12 and the refrigerant increases, and heat conduction efficiency improves.

As illustrated in FIG. 2, a fitting groove 11*c* may be formed on the first surface 11*a* of the base part 11 according to the present embodiment. The fitting groove 11*c* has an annular shape surrounding the heat exchange part 12 in a plan view.

As a material of the resin cover 20, it is possible to use a hydrophobic resin. As a resin constituting the resin cover 20, for example, it is possible to use a thermoplastic crystalline plastic such as polyphenylene sulfide (PPS), polyamide, polypropylene, polyethylene terephthalate, polyether ether ketone (PEEK), or polyacetal (POM). A thermal conductivity of the resin cover 20 is lower than a thermal conductivity of the base plate 10 made of a metal.

As illustrated in FIGS. 1 to 4, the resin cover 20 according to the present embodiment may have two members including a plate-shaped top plate part 20A and a main member 20B. The top plate part 20A and the main member 20B are joined to each other by, for example, heat fusion, ultrasonic bonding, or the like.

As illustrated in FIGS. 3 and 4, the main member 20B according to the present embodiment may include a first recessed portion 21 recessed downward from an upper surface of the main member 20B, and a second recessed portion 22 recessed upward from a lower surface of the main member 20B. The first recessed portion 21 and the second recessed portion 22 are formed over the entire main member 20B except for a circumferential edge portion in a plan view (see also FIG. 2).

The first recessed portion 21 and a communication hole 25*a* (to be described later) function as a low-temperature flow path P1 through which the refrigerant before receiving heat from the heat exchange part 12 flows. As illustrated in FIG. 2, the inflow hole H1 opens to the first recessed portion 21. As illustrated in FIGS. 3 and 4, the heat exchange part 12 is accommodated in the second recessed portion 22. As illustrated in FIG. 4, a dimension of the second recessed portion 22 in the first direction X is larger than a dimension of the heat exchange part 12 in the first direction X. Thereby, a gap in the first direction X (hereinafter referred to as a joining space S2) is provided between the second recessed portion 22 and the heat exchange part 12. The outflow hole H2 opens to the joining space S2.

Hereinafter, a portion of the resin cover 20 in which the recessed portions 21 and 22 are not formed in a plan view (a circumferential edge portion in a plan view) is referred to as a circumferential wall portion 24 (see also FIG. 2). The circumferential wall portion 24 has a cylindrical shape. A shape of the circumferential wall portion 24 corresponds to a shape of the fitting groove 11*c* formed on the base part 11. The circumferential wall portion 24 is joined to the base part 11 while being fitted into the fitting groove 11*c*. Details of joining the circumferential wall portion 24 and the base part 11 will be described later.

Also, as illustrated in FIGS. 3 and 4, a portion of the resin cover 20 positioned between the first recessed portion 21 and the second recessed portion 22 in the thickness direction Z is referred to as a blocking portion 25. The blocking portion 25 blocks the inside of the cylindrical circumferential wall portion 24 to separate the first recessed portion 21 and the second recessed portion 22 in the thickness direction Z. The blocking portion 25 is positioned at a center portion of the circumferential wall portion 24 in the thickness direction Z. In the present embodiment, the circumferential wall portion 24 and the blocking portion 25 may be integrally formed. The blocking portion 25 is joined to the heat exchange part 12. Details of joining the blocking portion 25 and the heat exchange part 12 will be described later.

A plurality of communication holes 25*a* that open to both the first recessed portion 21 and the second recessed portion 22 are formed in the blocking portion 25. That is, the communication holes 25*a* each penetrate the blocking portion 25 in the thickness direction Z. The communication hole 25*a* (the low-temperature flow path P1) opens to (i.e., communicates with) the heat exchange part 12. As illustrated in FIG. 2, the communication hole 25*a* according to the present embodiment may have a long hole shape in which a dimension in the first direction X is longer than a dimension in the second direction Y. Also, the blocking portion 25 according to the present embodiment may have a plurality of rows R in each of which a plurality (four in the illustrated example) of communication holes 25*a* are disposed at intervals in the first direction X. The plurality of rows R are disposed at intervals in the second direction Y.

As illustrated in FIG. 3, the blocking portion 25 has a plurality of third recessed portions 23 recessed upward from a lower surface of the blocking portion 25. The plurality of third recessed portions 23 are disposed at intervals in the second direction Y. Also, as illustrated in FIG. 4, the third recessed portions 23 each extend in the first direction X (see also FIG. 6). More specifically, the third recessed portion 23 according to the present embodiment may extend over the entire heat exchange part 12 in the first direction X. The third recessed portion 23 functions as a high-temperature flow path P2 through which the refrigerant after receiving heat from the heat exchange part 12 flows. The third recessed portion 23 (the high-temperature flow path P2) opens to (i.e., communicates with) the heat exchange part 12.

Here, the third recessed portion 23 (the high-temperature flow path P2) does not open to (i.e., is separated from) the first recessed portion 21 (the low-temperature flow path P1). That is, the third recessed portion 23 does not penetrate the blocking portion 25 in the thickness direction Z. Also, as illustrated in FIGS. 3 and 4, the third recessed portion 23 and the communication hole 25*a* are at different positions in the second direction Y, and the third recessed portion 23 does not open to the communication hole 25*a*. Thereby, the blocking portion 25 functions as a partition wall portion B that separates the first recessed portion 21 (the low-temperature flow path P1) and the third recessed portion 23 (the high-temperature flow path P2). The partition wall portion B has a role of preventing the refrigerant flowing through the low-temperature flow path P1 and the refrigerant flowing through the high-temperature flow path P2 from mixing without passing through the heat exchange part 12.

As illustrated in FIGS. 3 and 4, a fitting recessed portion 24*a* that opens to an inner circumferential side (an inner side in the first direction X or the second direction Y) of the circumferential wall portion 24 and upward is formed at an upper end portion of the circumferential wall portion 24. As illustrated in FIG. 2, the fitting recessed portion 24*a* is formed over the entire circumference of the circumferential wall portion 24. Also, a pair of support protrusions 25*b* protruding upward are provided at a center portion of the first recessed portion 21 in a plan view. As illustrated in FIGS. 3 and 4, the top plate part 20A is fixed to the main member 20B while being fitted to the fitting recessed portion 24*a* and in contact with the support protrusions 25*b*. More specifically, the top plate part 20A is joined to the fitting recessed portion 24*a* and the support protrusions 25*b* by, for example, heat fusion, ultrasonic bonding, or the like.

Hereinafter, the circumferential wall portion 24 of the main member 20B and the top plate part 20A may be collectively referred to as an outer wall part W of the resin cover 20. The outer wall part W has a topped cylindrical shape. The internal space S described above is a space surrounded by the topped cylindrical outer wall part W and the plate-shaped base part 11 of the base plate 10. As illustrated in FIGS. 3 and 4, the heat exchange part 12, the low-temperature flow path P1, and the high-temperature flow path P2 described above are positioned in the internal space S.

Hereinafter, details of joining the base plate 10 and the resin cover 20 will be described. In the present embodiment, the fitting groove 11*c* and the circumferential wall portion 24 (the outer wall part W) may be joined by heat fusion, and the upper end surface 13*a* of the fin 13 and the blocking portion 25 (the partition wall portion B) may be joined by heat fusion.

Figure 5:
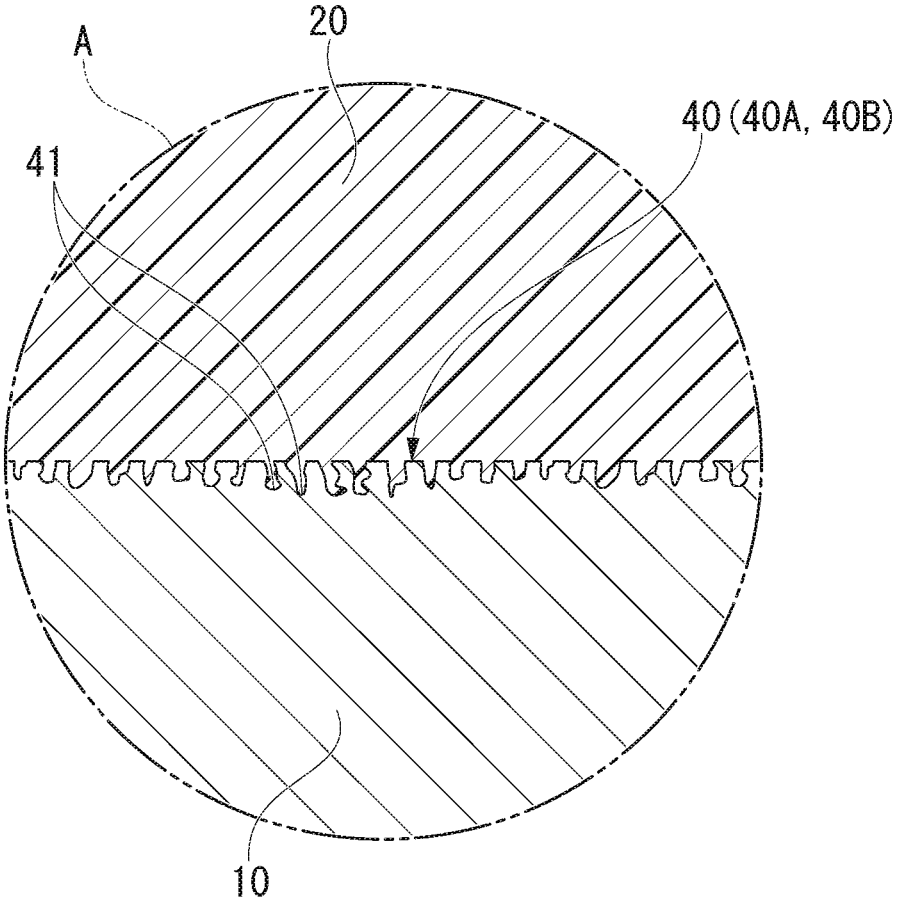
FIG. 5 is an enlarged view of an area A illustrated in FIG. 3.

As illustrated in FIGS. 3 and 4, a roughened portion 40 is formed on each of the fitting groove 11*c* of the base part 11 and the upper end surface 13*a* of the fin 13 by an appropriate surface treatment to be described later. Hereinafter, the roughened portion 40 formed on the fitting groove 11*c* is referred to as a first roughened portion 40A, and the roughened portion 40 formed on the upper end surface 13*a* of the fin 13 is referred to as a second roughened portion 40B. As illustrated in FIG. 5, each of the roughened portions 40A and 40B has a plurality of micropores 41.

During heat fusion, the base plate 10 is heated, and the circumferential wall portion 24 and the blocking portion 25 are pressed against the roughened fitting groove 11*c* and upper end surface 13*a* (that is, the first roughened portion 40A and the second roughened portion 40B), respectively. At this time, the base plate 10 is heated to a temperature equal to or higher than a melting point of the resin constituting the resin cover 20. Therefore, a portion of the circumferential wall portion 24 and the blocking portion 25 pressed against the base plate 10 are melted and enter the micropores 41.

Then, when the base plate 10 is cooled after heating, the molten resin becomes solidified inside the micropores 41. The solidified resin functions as an anchor, and the resin cover 20 and the base plate 10 are firmly joined at both the first roughened portion 40A and the second roughened portion 40B. Since the base plate 10 and the resin cover 20 are firmly joined, it is possible to improve airtightness of the internal space S.

As a surface treatment performed on the fitting groove 11*c* and the upper end surface 13*a* to form the roughened portions 40A and 40B, it is possible to employ laser irradiation or a chemical conversion treatment such as etching. For example, the plurality of micropore 41 having a depth of about 10 to 100 μm may be formed in the joining region (the fitting groove 11*c* and the upper end surface 13*a*) by using a laser. Also, the plurality of micropores 41 may be formed in a closed loop at predetermined intervals. A distance between the micropores 41 may be, for example, about 500 μm from a diameter of the micropore 41. Also, the joining region may be oxidized. According to these methods, it is possible to secure a sufficient joining surface area between the base plate 10 and the resin cover 20.

Next, an operation of the cold plate 100 configured as above will be described.

The cold plate 100 is a heat dissipation module that receives heat from a heating element via the base plate 10 and releases the received heat to the outside. Hereinafter, a principle of heat dissipation will be described.

Figure 6:
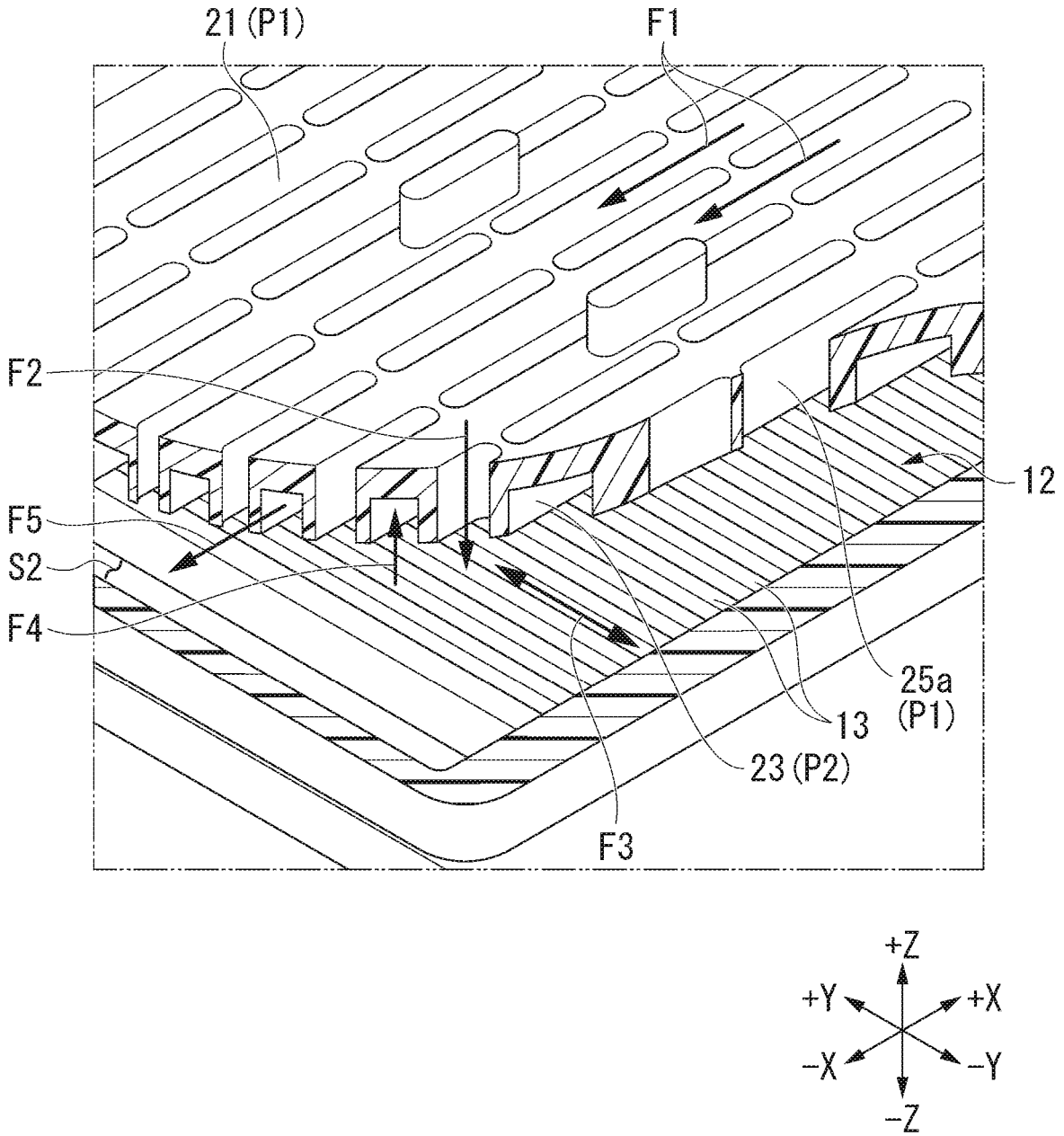
FIG. 6 is a partial cutaway view illustrating the cold plate according to the first embodiment of the present invention.

A refrigerant is supplied to the internal space S of the cold plate 100 through the inflow hole H1. As illustrated in FIGS. 4 and 6, the refrigerant supplied from the inflow hole H1 flows through the first recessed portion 21 (the low-temperature flow path P1) (illustrated as a flow F1). Thereafter, as illustrated in FIGS. 3 and 6, the refrigerant reaches the heat exchange part 12 through the communication hole 25*a* (the low-temperature flow path P1) (illustrated as a flow F2). The refrigerant that has reached the heat exchange part 12 moves in the second direction Y along the fins 13 while receiving heat from the heat exchange part 12 (illustrated as a flow F3), and reaches any one of the plurality of third recessed portions 23 (the high-temperature flow path P2) (illustrated as a flow F4). As illustrated in FIGS. 4 and 6, the refrigerant that has reached the third recessed portion 23 moves in the first direction X along the third recessed portion 23 and reaches the joining space S2 (illustrated as a flow F5). The refrigerant that has reached the joining space S2 is discharged to the outside of the cold plate 100 through the outflow hole H2. As described above, in the cold plate 100 according to the present embodiment, the refrigerant may flow in the order of the low-temperature flow path P1, the heat exchange part 12, and the high-temperature flow path P2. Through this processing, it is possible for the cold plate 100 to receive heat from the heating element and release the received heat to the outside.

The cold plate 100 may be a so-called two-phase flow cooling type cold plate. That is, the cold plate 100 may be configured such that the refrigerant evaporates from a liquid to a gas in the heat exchange part 12. In this case, it is possible to efficiently cool the heating element by evaporative latent heat of the refrigerant. In the two-phase flow cooling type cold plate 100, a liquid refrigerant flows through the low-temperature flow path P1, and a gas refrigerant flows through the high-temperature flow path P2.

Also, the cold plate 100 may be a so-called jet cooling type cold plate. That is, the cold plate 100 may be configured such that the refrigerant is accelerated by a flow path resistance of the communication holes 25*a* and is ejected at a high flow rate to the heat exchange part 12. Even with this configuration, it is possible to efficiently cool the heating element by the cold plate 100. In the jet cooling type cold plate 100, a liquid refrigerant flows through both the low-temperature flow path P1 and the high-temperature flow path P2.

As described above, the cold plate 100 according to the present embodiment may include the housing 1 having the base plate 10 which has the base part 11 and the resin cover 20 which has the outer wall part W (the top plate part 20A and the circumferential wall portion 24) joined to the base part 11, in which the internal space S surrounded by the base part 11 and the outer wall part W, the inflow hole H1 communicating with the internal space S and into which a refrigerant flows, and the outflow hole H2 communicating with the internal space S and through which the refrigerant flows out are formed in the housing 1, the base plate 10 includes the heat exchange part 12 positioned in the internal space S and configured to transmit heat received from the heating element to the refrigerant, and the resin cover 20 includes the low-temperature flow path P1 (the first recessed portion 21) positioned in the internal space S and through which the refrigerant before receiving heat from the heat exchange part 12 flows, and the high-temperature flow path P2 (the third recessed portion 23) positioned in the internal space S, through which the refrigerant after receiving heat from the heat exchange part 12 flows, and not opening to the low-temperature flow path P1.

According to this configuration, since the cold plate 100 has the low-temperature flow path P1 and the high-temperature flow path P2, it is possible to apply the two-phase flow cooling method or the jet cooling method to the cold plate 100. Also, since the low-temperature flow path P1 and the high-temperature flow path P2 are provided in the resin cover 20, it is possible to form the flow paths P1 and P2 more easily than, for example, when the flow paths P1 and P2 are formed of a metal. Also, since the low-temperature flow path P1 is formed of a resin having a lower thermal conductivity than a metal, when the two-phase flow cooling method is applied to the cold plate 100, it is possible to prevent the refrigerant from evaporating not in the heat exchange part 12 but in the low-temperature flow path P1. Also, when the high-temperature flow path P2 is formed of a hydrophobic resin, it is possible to prevent the refrigerant that has once evaporated in the heat exchange part 12 from adhering to the high-temperature flow path P2 as a liquid. Thereby, it is possible to stabilize a cooling efficiency of the cold plate 100.

Also, the resin cover 20 includes the partition wall portion B (the blocking portion 25) separating the low-temperature flow path P1 and the high-temperature flow path P2, and the partition wall portion B is joined to the base plate 10. With this configuration, it is possible to join the base plate 10 and the resin cover 20 more firmly than, for example, when only the outer wall part W is joined to the base plate 10. Also, when the partition wall portion B is joined to the resin cover 20, it is possible to reduce a possibility that the refrigerant will move between the low-temperature flow path P1 and the high-temperature flow path P2 without passing through the heat exchange part 12. Particularly, when the two-phase flow cooling method is applied to the cold plate 100, an internal pressure of the cold plate 100 increases due to an increase in volume of the refrigerant due to evaporation. Thereby, there is an increased possibility that the refrigerant will move between the low-temperature flow path P1 and the high-temperature flow path P2 without passing through the heat exchange part 12. Therefore, the partition wall portion B may be joined to the base plate 10 to prevent the refrigerant from moving between the flow paths P1 and P2.

Also, the partition wall portion B is joined to the heat exchange part 12. More specifically, the partition wall portion B is joined to the plurality of fins 13. With this configuration, it is possible to use the heat exchange part 12 as a joining object for the partition wall portion B.

Also, a portion at which the low-temperature flow path P1 opens to the heat exchange part 12 (the third recessed portion 23) and a portion at which the high-temperature flow path P2 opens to the heat exchange part 12 (the communication hole 25*a*) are at different positions in the second direction Y intersecting the first direction X in which the high-temperature flow path P2 extends, and the heat exchange part 12 includes the plurality of fins 13 extending in the second direction Y. The third recessed portion, which is a portion at which the low-temperature flow path P1 opens to the heat exchange part 12, is also referred to as a first portion. The communication hole 25*a*, which is a portion at which the high-temperature flow path P2 opens to the heat exchange part 12, is also referred to as a second portion. With this configuration, it is possible to guide the refrigerant from the low-temperature flow path P1 to the high-temperature flow path P2 by using the fins 13.

Second Embodiment

Next, a second embodiment will be described, but a basic configuration is the same as that of the first embodiment. Therefore, components which are the same are denoted by the same reference signs, description thereof will be omitted, and only different points will be described.

Figure 7:
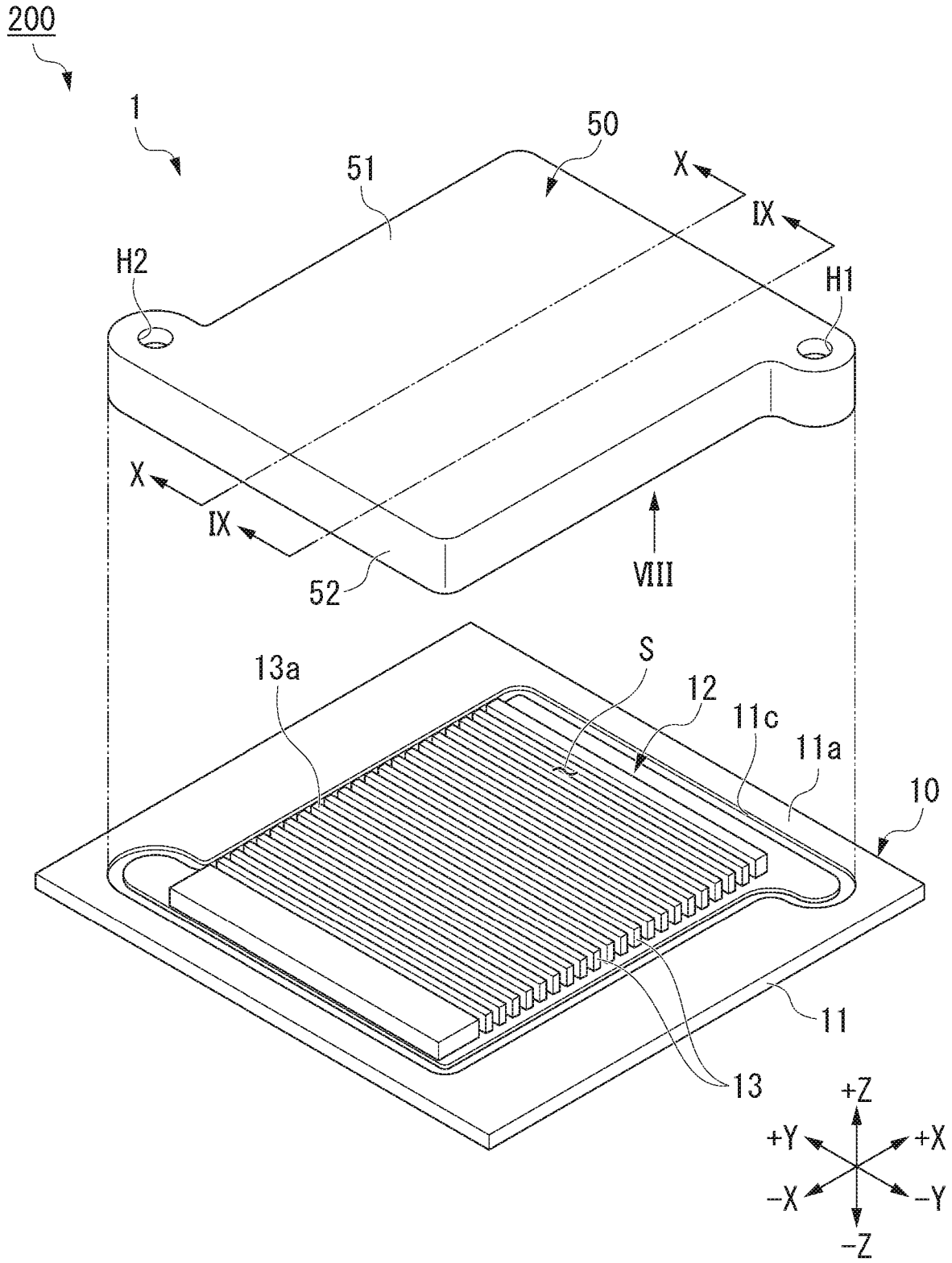
FIG. 7 is an exploded view illustrating a cold plate according to a second embodiment of the present invention.

As illustrated in FIG. 7, a cold plate 200 according to the present embodiment may include a resin cover 50 having a different shape from the resin cover 20 according to the first embodiment. The resin cover 50 according to the present embodiment may be different from the resin cover 20 according to the first embodiment and may be formed of an integral member.

Figure 8:
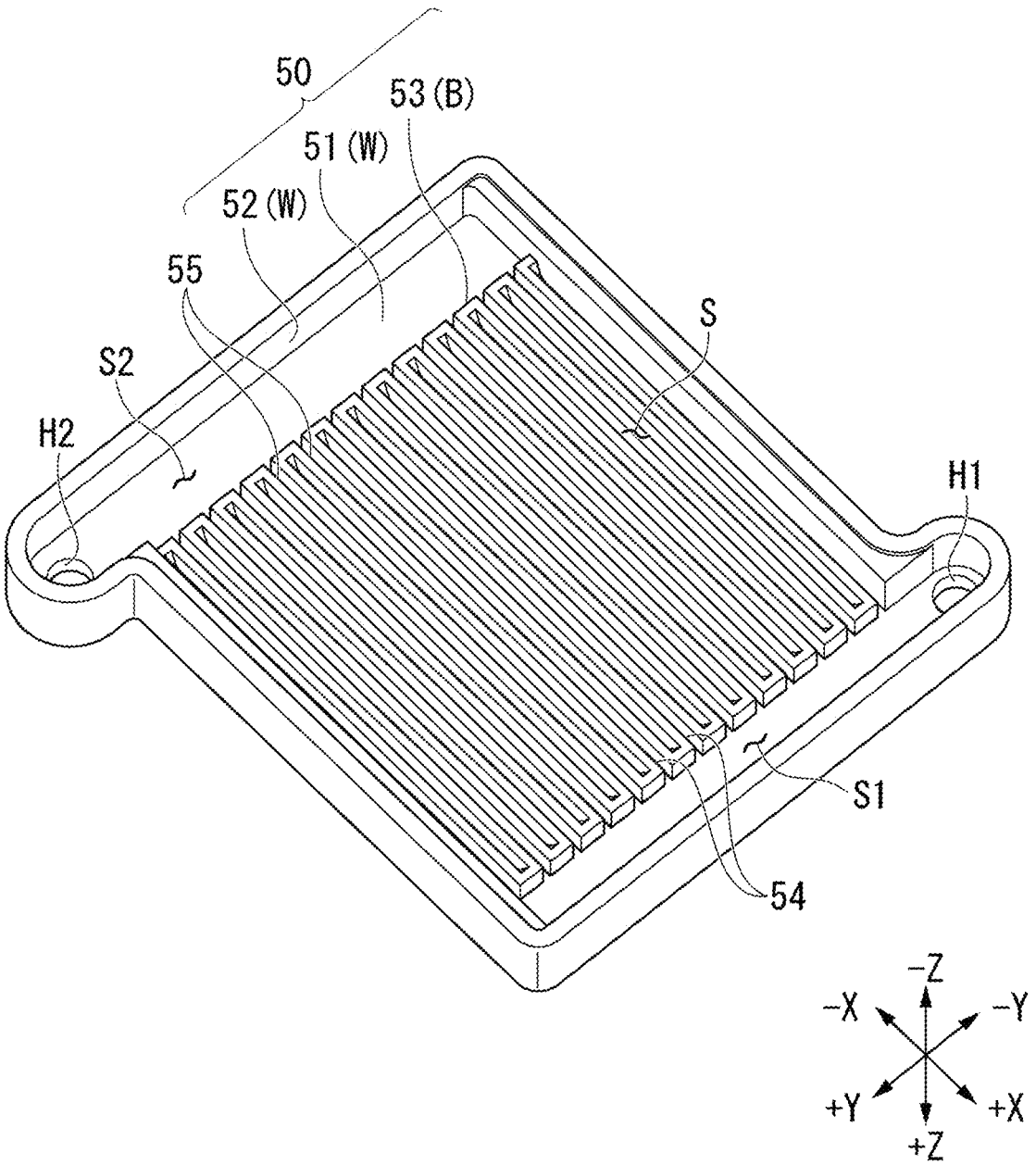
FIG. 8 is a perspective view illustrating a resin cover according to the second embodiment of the present invention.

Specifically, the resin cover 50 according to the present embodiment may include a top plate portion 51, a circumferential wall portion 52, and a meandering wall portion 53 as illustrated in FIG. 8. The top plate portion 51, the circumferential wall portion 52, and the meandering wall portion 53 are integrally formed with each other. As illustrated in FIGS. 7 to 10, the top plate portion 51 and the circumferential wall portion 52 constitute a topped cylindrical outer wall part W similarly to the top plate part 20A and the circumferential wall portion 24 according to the first embodiment. The circumferential wall portion 52 (outer wall part W) is joined to a fitting groove 11*c* of a base part 11 similarly to the first embodiment.

Figure 9:
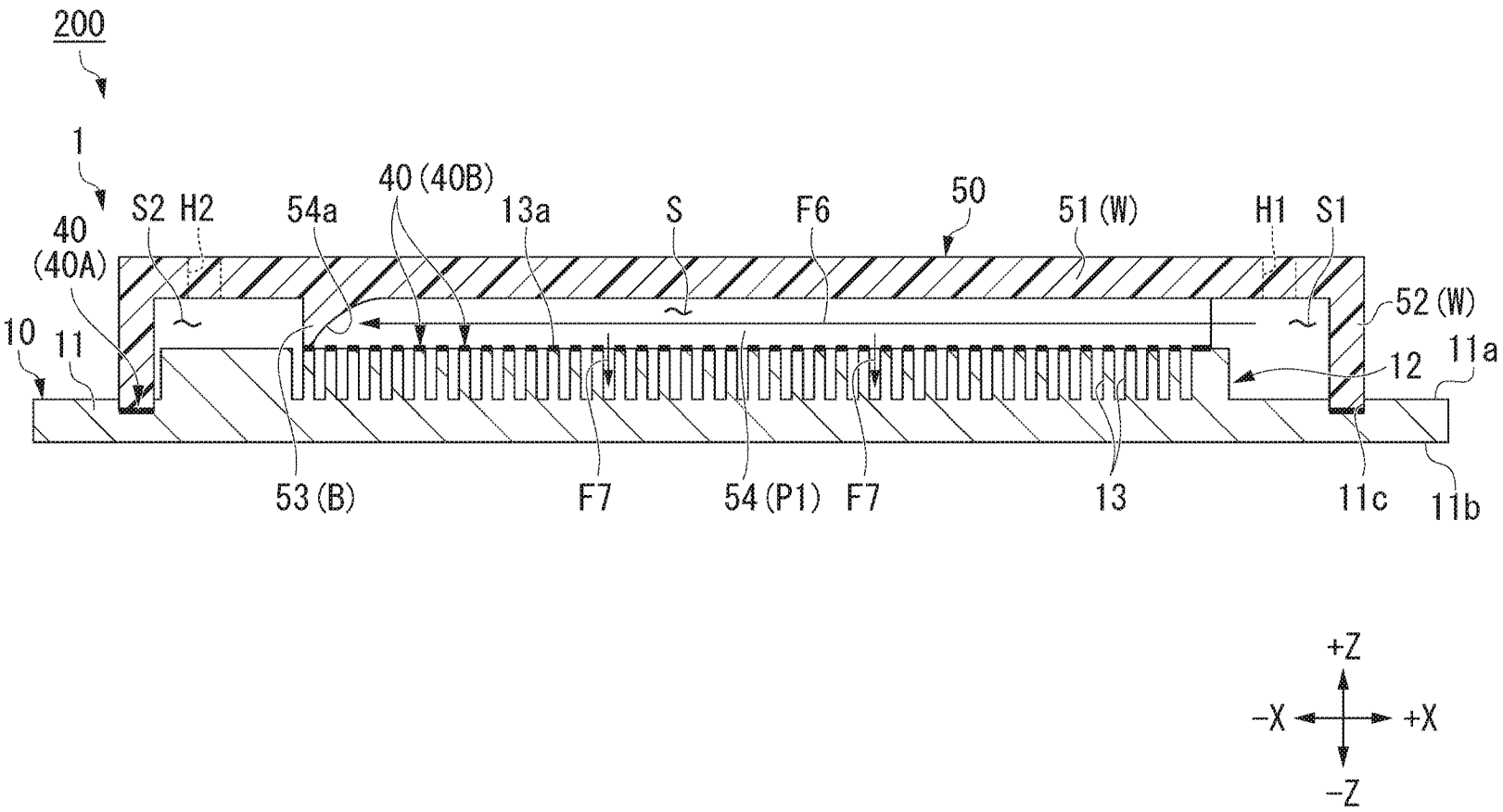
FIG. 9 is a cross-sectional view including an inlet recessed portion taken along line IX-IX illustrated in FIG. 7.
Figure 10:
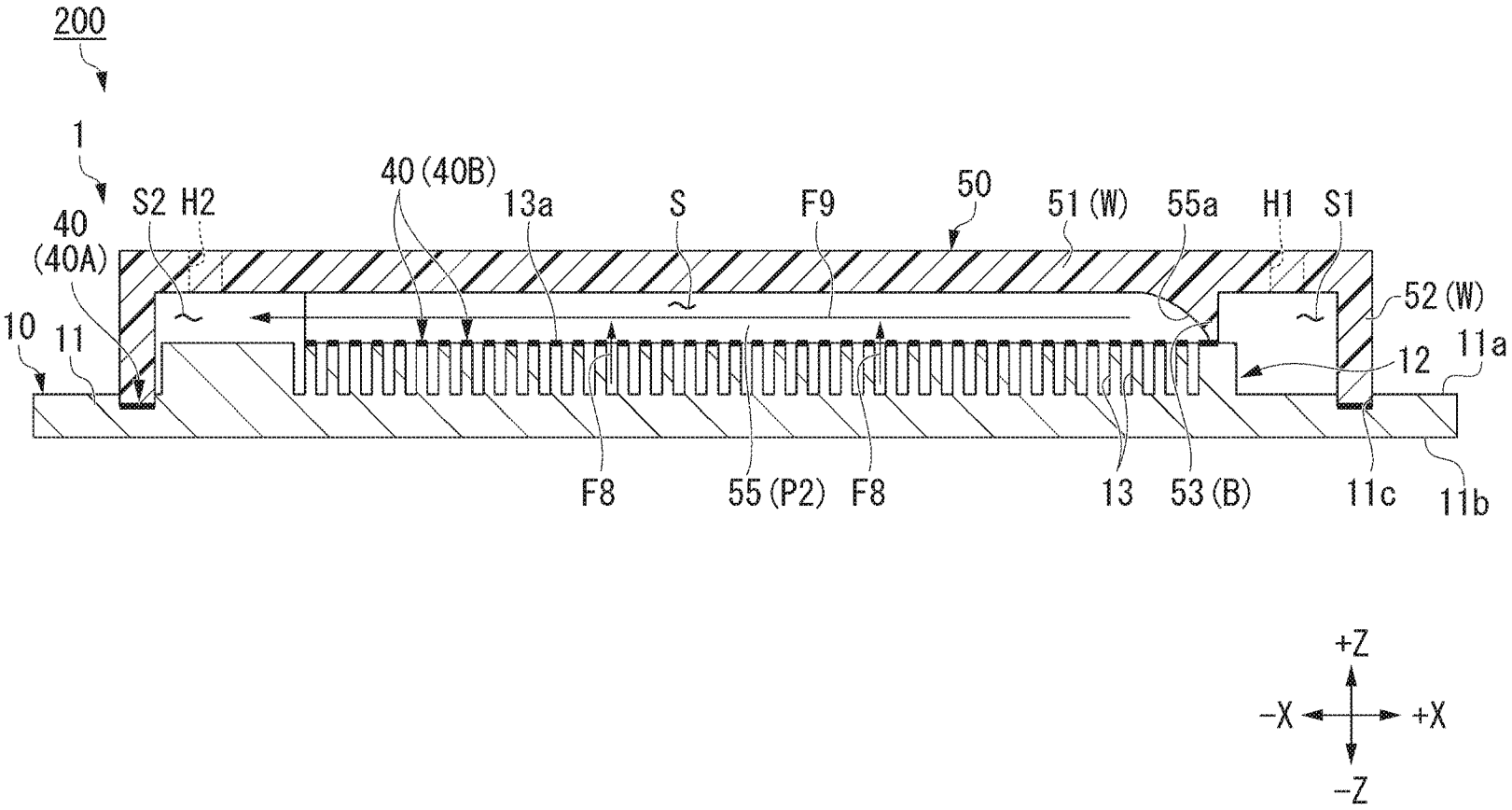
FIG. 10 is a cross-sectional view including an outlet recessed portion taken along line X-X illustrated in FIG. 7.

As illustrated in FIGS. 9 and 10, the meandering wall portion 53 protrudes downward from the top plate portion 51. The meandering wall portion 53 is positioned in an internal space S surrounded by the outer wall part W (the top plate portion 51 and the circumferential wall portion 52) and the base part 11 of a base plate 10. As illustrated in FIG. 8, the meandering wall portion 53 is disposed at a center portion of the meandering wall portion 53 in a plan view.

A dimension of the meandering wall portion 53 in a first direction X is smaller than an inner diameter of the outer wall part W in the first direction X. Thereby, two gaps in the first direction X are provided between the meandering wall portion 53 and the outer wall part W. The two gaps are positioned on both sides of the meandering wall portion 53 in the first direction X. An inflow hole H1 opens to one gap (hereinafter referred to as a branch space S1) of the two gaps. An outflow hole H2 opens to the other gap (hereinafter referred to as a joining space S2) of the two gaps.

As illustrated in FIG. 8, the meandering wall portion 53 has a corrugated shape extending in a second direction Y while meandering in the first direction X. Thereby, the meandering wall portion 53 has a plurality of inlet recessed portions 54 opening to the branch space S1 and a plurality of outlet recessed portions 55 opening to the joining space S2. The plurality of inlet recessed portions 54 and the plurality of outlet recessed portions 55 are alternately disposed in the second direction Y. Note that, both ends of the meandering wall portion 53 in the second direction Y are connected to the outer wall part W.

As illustrated in FIG. 9, the inlet recessed portions 54 each do not open to the joining space S2. As illustrated in FIG. 10, the outlet recessed portions 55 each do not open to the branch space S1. In the present embodiment, the inlet recessed portion 54 may function as a low-temperature flow path P1, and the outlet recessed portion 55 may function as a high-temperature flow path P2. Also, the meandering wall portion 53 functions as a partition wall portion B that separates the low-temperature flow path P1 (the inlet recessed portion 54) and the high-temperature flow path P2 (the outlet recessed portion 55). The meandering wall portion 53 serving as the partition wall portion B is joined to a heat exchange part 12 (an upper end surface 13*a* of a fin 13) positioned in the internal space S. The inlet recessed portion 54 and the outlet recessed portion 55 open to the heat exchange part 12.

Similarly to the cold plate 100 according to the first embodiment, the cold plate 200 configured as above functions as a heat dissipation module that receives heat from a heating element via the base plate 10 and releases the received heat to the outside. Hereinafter, a principle of heat dissipation will be described.

As illustrated in FIG. 9, the refrigerant supplied from the inflow hole H1 branches from the branch space S1 to the plurality of inlet recessed portions 54 (the low-temperature flow path P1), and then flows in the first direction X along the inlet recessed portions 54 (the low-temperature flow path P1) (illustrated as a flow F6). Thereafter, the refrigerant is blocked at a distal end portion 54*a* of the inlet recessed portion 54 and moves to the heat exchange part 12 (illustrated as a flow F7). The refrigerant that has reached the heat exchange part 12 moves in the second direction Y along the fin 13 while receiving heat from the heat exchange part 12, and reaches any one of the plurality of outlet recessed portions 55 (the high-temperature flow path P2) (illustrated as a flow F8) as illustrated in FIG. 10. The refrigerant that has reached the outlet recessed portion 55 moves in the first direction X along the outlet recessed portion 55 and reaches the joining space S2 (illustrated as a flow F9). The refrigerant that has reached the joining space S2 is discharged to the outside of the cold plate 200 through the outflow hole H2. As described above, also in the cold plate 200 according to the present embodiment, the refrigerant may flow in the order of the low-temperature flow path P1, the heat exchange part 12, and the high-temperature flow path P2. Through this processing, it is possible for the cold plate 200 to receive heat from the heating element and release the received heat to the outside.

Note that, as illustrated in FIG. 9, the distal end portion 54*a* of the inlet recessed portion 54 may have an arcuate shape in a cross section intersecting the second direction Y. According to this configuration, it is possible to promote a flow of the refrigerant from the inlet recessed portion 54 (the low-temperature flow path P1) to the heat exchange part 12. Similarly, a distal end portion 55*a* of the outlet recessed portion 55 may have an arcuate shape in a cross section intersecting the second direction Y (see FIG. 10). According to this configuration, it is possible to suppress retention of the refrigerant at the distal end portion 55*a*.

As described above, in the cold plate 200 according to the present embodiment, the resin cover 50 may have the low-temperature flow path P1 and the high-temperature flow path P2 similarly to the cold plate 100 according to the first embodiment. With this configuration, it is possible to form the flow paths P1 and P2 can more easily than, for example, when the flow paths P1 and P2 are formed of a metal.

Further, in the cold plate 200 according to the present embodiment, the outer wall part W, the low-temperature flow path P1, and the high-temperature flow path P2 may be integrally formed. With this configuration, it is possible to manufacture the resin cover 50 more easily than, for example, when the outer wall part W, the low-temperature flow path P1, and the high-temperature flow path P2 are formed separately.

Note that, the technical scope of the present invention is not limited to the above-described embodiments, and various modifications may be made in a range not departing from the meaning of the present invention.

Figure 11:
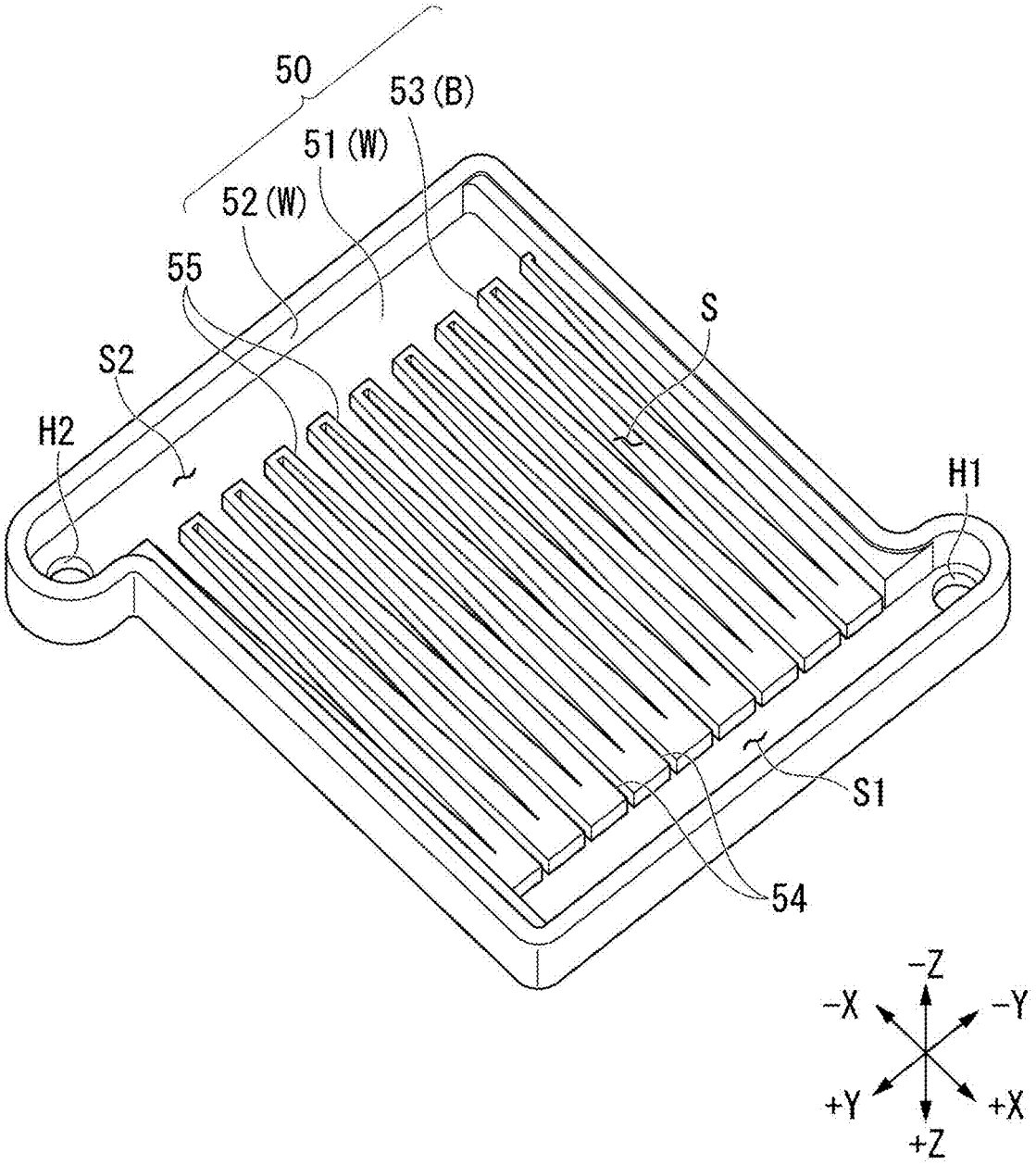
FIG. 11 is a perspective view illustrating a resin cover according to a modified example of the second embodiment of the present invention.

FIG. 11 is a view illustrating a modified example of the resin cover 50 according to the second embodiment. As illustrated in FIG. 11, a width (dimension in the second direction Y) of the outlet recessed portion 55 (the high-temperature flow path P2) may not be constant in the first direction X. In this modified example, the outlet recessed portion 55 (the high-temperature flow path P2) has a shape that gradually broadens toward the outflow hole H2. According to this configuration, the refrigerant that has reached the outlet recessed portion 55 (the high-temperature flow path P2) flows more easily toward the outflow hole H2. Thereby, it is possible to further improve a cooling efficiency of the cold plate 200.

Also, the heat exchange part 12 may not have the fins 13. A configuration of the heat exchange part 12 may be changed as appropriate as long as it is possible to transmit heat received from the heating element to the refrigerant.

Also, depending on the position and shape of the partition wall portion B, the partition wall portion B may be joined to a portion of the base plate 10 other than the heat exchange part 12.

Also, the partition wall portion B may not be joined to the base plate 10 as long as it is possible to suppress movement of the refrigerant between the low-temperature flow path P1 and the high-temperature flow path P2.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

100, 200 Cold plate
1 Housing
10 Base plate
11 base part
12 Heat exchange part
13 Fin
20, 50 Resin cover
W Outer wall part
B Partition wall portion
H1 Inflow hole
H2 Outflow hole
P1 Low-temperature flow path
P2 High-temperature flow path

What is claimed is:

1. A cold plate comprising:
a housing comprising a metal base plate and a resin cover, wherein
the metal base plate comprises:
a base part; and
a heat exchange part that transfers heat absorbed from a heating element to a refrigerant, the resin cover comprises an outer wall part joined to the base part, the housing has:
an internal space, surrounded by the base part and the outer wall part, in which the heat exchange part is disposed;
an inflow hole that communicates with the internal space and into which the refrigerant flows; and
an outflow hole that communicates with the internal space and through which the refrigerant flows out,
the resin cover further comprises:
a low-temperature refrigerant flow path, disposed in the internal space, through which the refrigerant flows before absorbing heat from the heat exchange part; and
a high-temperature refrigerant flow path, disposed in the internal space, through which the refrigerant flows after absorbing heat from the heat exchange part,
the high-temperature refrigerant flow path is separated from the low-temperature refrigerant flow path, and
at least part of the low-temperature refrigerant flow path overlaps the high-temperature refrigerant flow path when viewed in a thickness direction of the cold plate.

2. The cold plate according to claim 1, wherein
the resin cover comprises a partition wall portion that:
separates the low-temperature refrigerant flow path and the high-temperature refrigerant flow path, and
is joined to the metal base plate.

3. The cold plate according to claim 2, wherein the partition wall portion is joined to the heat exchange part.

4. The cold plate according to claim 1, wherein
the low-temperature refrigerant flow path communicates with a first portion of the heat exchange part,
the high-temperature refrigerant flow path communicates with a second portion of the heat exchange part,
the high-temperature refrigerant flow path extends in a first direction,
a position of the first portion is different from a position of the second portion in a second direction intersecting the first direction, and
the heat exchange part comprises fins extending in the second direction.

5. The cold plate according to claim 1, wherein the outer wall part, the low-temperature refrigerant flow path, and the high-temperature refrigerant flow path are integrally formed.

6. The cold plate according to claim 1, wherein the high-temperature refrigerant flow path has a shape gradually broadening toward the outflow hole.

7. The cold plate according to claim 1, wherein the resin cover further comprises:
a top plate;
a partition wall that separates the low-temperature refrigerant flow path from the high-temperature refrigerant flow path; and
a support protrusion that fixes the partition wall with the top plate without separating the low-temperature refrigerant flow path from the high-temperature refrigerant flow path.

8. A cold plate comprising:
a housing comprising a metal base plate and a resin cover, wherein
the metal base plate comprises:
a base part; and
a heat exchange part that transfers heat absorbed from a heating element to a refrigerant,
the resin cover comprises an outer wall part joined to the base part,
the housing has:
an internal space, surrounded by the base part and the outer wall part, in which the heat exchange part is disposed;
an inflow hole that communicates with the internal space and into which the refrigerant flows; and
an outflow hole that communicates with the internal space and through which the refrigerant flows out,
the resin cover further comprises:
a low-temperature refrigerant flow path, disposed in the internal space, through which the refrigerant flows before absorbing heat from the heat exchange part; and
a high-temperature refrigerant flow path, disposed in the internal space, through which the refrigerant flows after absorbing heat from the heat exchange part, the high-temperature refrigerant flow path is separated from the low-temperature refrigerant flow path, and the resin cover further comprises:

a top plate;

a partition wall that separates the low-temperature refrigerant flow path from the high-temperature refrigerant flow path; and a support protrusion that fixes the partition wall with the top plate without separating the low-temperature refrigerant flow path from the high-temperature refrigerant flow path.

9. A cold plate comprising:

a housing comprising a metal base plate and a resin cover, wherein the metal base plate comprises:

a base part; and a heat exchange part that transfers heat absorbed from a heating element to a refrigerant, the resin cover comprises an outer wall part joined to the base part, the housing has:

an internal space, surrounded by the base part and the outer wall part, in which the heat exchange part is disposed;

an inflow hole that communicates with the internal space and into which the refrigerant flows; and an outflow hole that communicates with the internal space and through which the refrigerant flows out, the resin cover further comprises:

a low-temperature refrigerant flow path, disposed in the internal space, through which the refrigerant flows before absorbing heat from the heat exchange part; and a high-temperature refrigerant flow path, disposed in the internal space, through which the refrigerant flows after absorbing heat from the heat exchange part, the high-temperature refrigerant flow path is separated from the low-temperature refrigerant flow path, the high-temperature refrigerant flow path comprises a plurality of high-temperature refrigerant flow paths, and each of the plurality of high-temperature refrigerant flow paths extends substantially straight and has a shape gradually broadening toward the outflow hole when viewed in a thickness direction of the cold plate.

* * * * *